US007077766B2

(12) United States Patent
Bennett et al.

(10) Patent No.: US 7,077,766 B2
(45) Date of Patent: Jul. 18, 2006

(54) BASKETBALL TRAINING DEVICE

(76) Inventors: Robert A. Bennett, 120 Sheffield Cir., Sheffield, CT (US) 06614; Timothy Conlon, 28 E. 9th St., Derby, CT (US) 06418; Charles Stochmal, 8 Dolan Cir., Seymour, CT (US) 06483

( * ) Notice: Subject to any disclaimer, the term of this patent is extended or adjusted under 35 U.S.C. 154(b) by 63 days.

(21) Appl. No.: 10/881,241

(22) Filed: Jun. 30, 2004

(65) Prior Publication Data

US 2006/0003856 A1 Jan. 5, 2006

(51) Int. Cl.
*A63B 69/00* (2006.01)

(52) U.S. Cl. ..... 473/448; 248/118.3

(58) Field of Classification Search ..... 473/448, 473/447, 446, 450, 422, 452, 464; 73/472; 248/118.3; 434/248; 401/6
See application file for complete search history.

(56) References Cited

U.S. PATENT DOCUMENTS 389,053 A * 9/1888 Brown ..... 248/118.3
649,901 A * 5/1900 Brennan ..... 5/505.1
1,516,795 A * 11/1924 Schwarting ..... 5/646
2,749,196 A * 6/1956 Wolfe ..... 248/214
3,929,309 A * 12/1975 De Vore ..... 248/118
4,237,873 A * 12/1980 Terry et al. ..... 602/20
5,104,073 A * 4/1992 VanBeek et al. ..... 248/118.3
6,224,026 B1 * 5/2001 Dubois ..... 248/118.3

* cited by examiner

*Primary Examiner*—Eugene Kim
*Assistant Examiner*—M. Chambers

(57) ABSTRACT

Basketball training apparatus uses a first vertical support member having a lower end adapted to rest on a supporting surface. An elongated guide rod extends in longitudinal direction. An adjustable wrist support is adapted for manual engagement and disengagement of a wrist of a user. A second elongated member is secured rotatably at one end to one end of the rod and extends at right angles thereto. The other end of the second member is secured to the wrist support. A device is secured to the upper end of the member and is manually pivotable about a horizontal axis disposed at right angles to the longitudinal direction, the device providing a guide channel through which the rod extends.

1 Claim, 2 Drawing Sheets

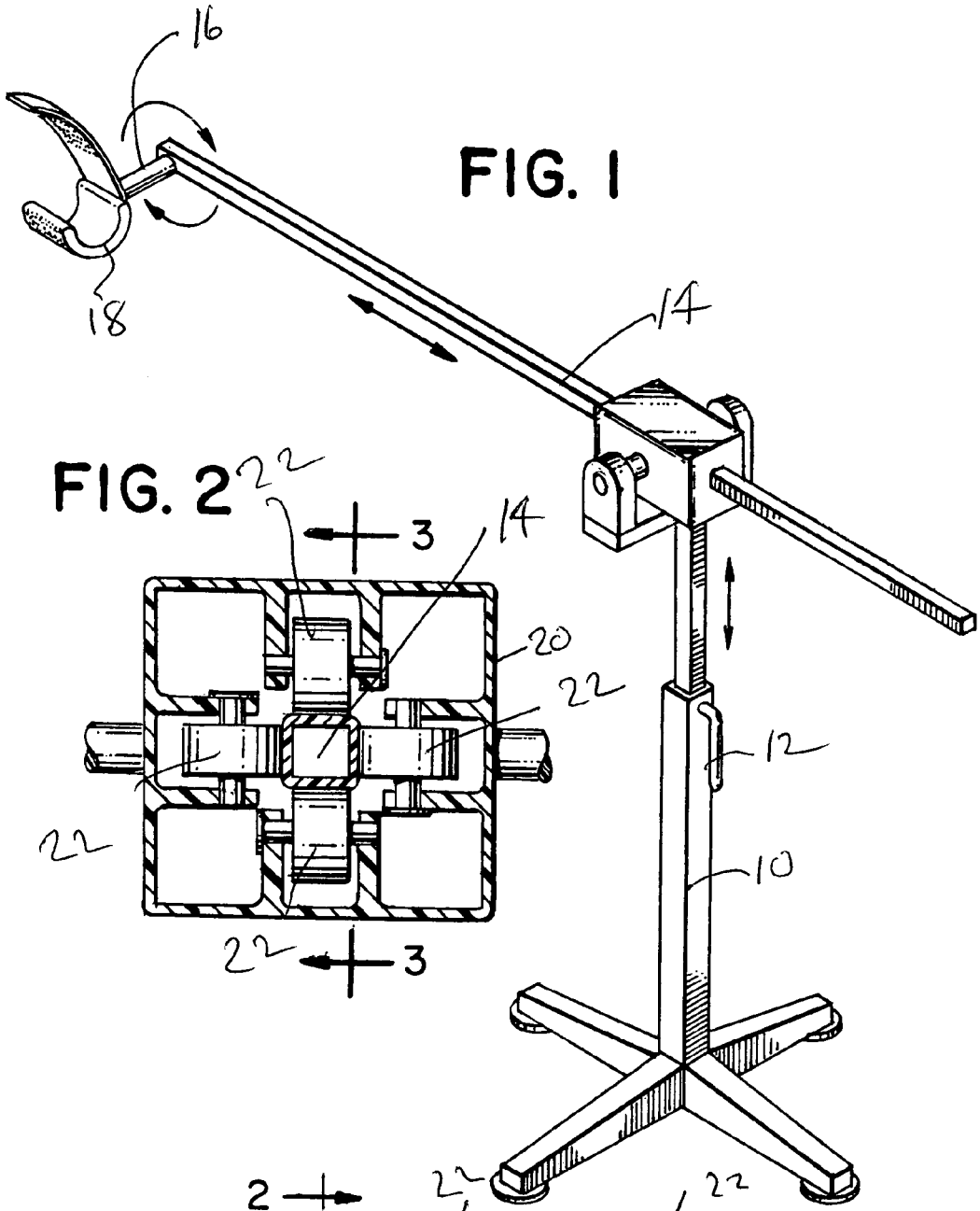
FIG. 1
FIG. 2
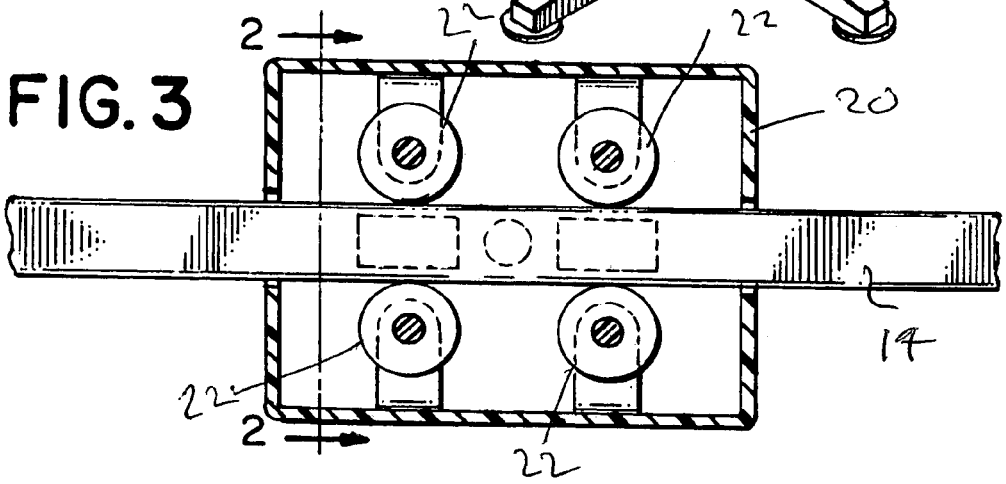
FIG. 3

BASKETBALL TRAINING DEVICE

FIELD OF THE INVENTION

The present invention is directed toward apparatus for training basketball players in proper basketball shooting techniques.

THE PRIOR ART

U.S. Pat. No. 5,324,026 discloses a training aid which is used by basketball players and serves to train the player to keep his elbow straight and move it in a straight up and down direction which is the proper way for shooting a basket in the game of basket ball. To this end, an upright stand having walls with an accordion-like arm attached at one end to one of the walls. An elbow harness is secured to the other free end of the arm. The player inserts his arm in the harness, holds the ball in his hands, and throws the ball at the basket. The arm has the purpose of confining the arm movement in the proper manner so that the ball sinks into the basket.

The present invention is directed toward a new and improved apparatus for training basketball players in proper basketball shooting techniques wherein the upright stand, the elbow harness and the accordion like arm are eliminated and a sliding arm structure with a wrist support is utilized to provide a simpler, more accurate training.

SUMMARY OF THE INVENTION

In accordance with the principles of this invention, basketball training apparatus utilizes a first vertical support member having a lower end adapted to rest upon a supporting surface.

An elongated guide rod is employed and extends in a longitudinal direction. A second elongated member is secured rotatably at one end to one end of said rod and extending at right angles thereto. An adjustable wrist support adapted for manual engagement and disengagement of a wrist of a user is secured to the other end of the second member.

Means secured to the upper end of the member is manually pivotable about a horizontal axis disposed at right angles to said longitudinal direction. This means provides a guide channel through which said rod extends, said channel enabling the rod to be manually slid back and forth in said longitudinal direction while preventing said rod from moving in any other direction.

In use the height of the first member is adjusted to accommodate a player being trained. The player manually adjusts the vertical inclination of the bar to aim at the basket. The player holds the basketball in his hand, secures the wrist support to his wrists, and throws the ball at the basket.

The elbow is held straight and is moved correctly in a straight up and down direction. As long as the bar is properly aimed and the ball is thrown with enough force, the ball will fall in the basket.

Additional objects and advantages of this invention will either be explained or will become apparent from the drawings and detailed description which follows.

BRIEF DESCRIPTION OF THE DRAWINGS

FIG. 1 is a perspective view of a preferred embodiment of this invention.

FIG. 2 is a cross sectional view taken along line 2—2 of a casing shown in FIG. 3.

FIG. 3 is a sectional view taken along line 3—3 of the casing shown in FIG. 2.

DETAILED DESCRIPTION OF PREFERRED EMBODIMENT

Figure 4:
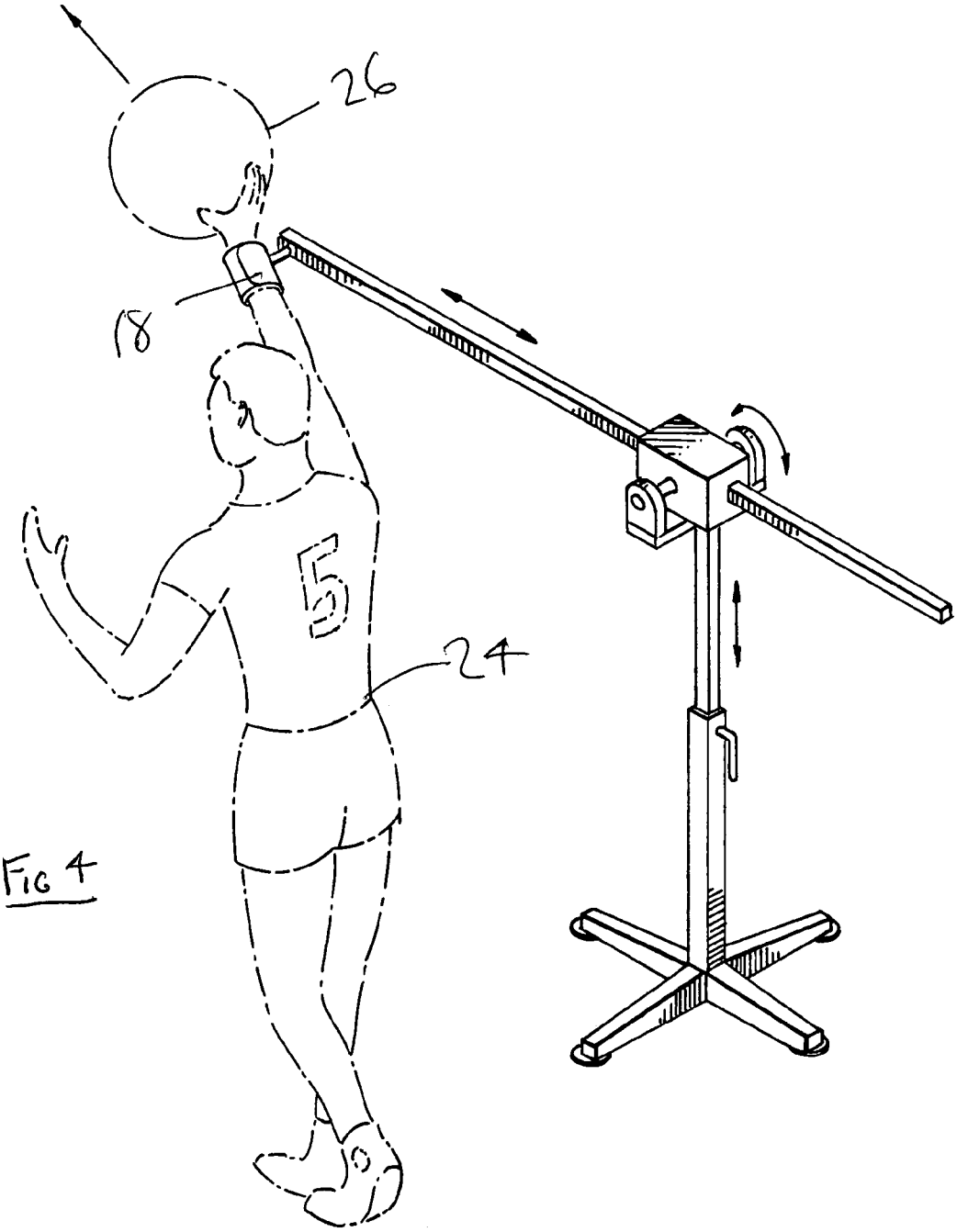
FIG. 4 is a perspective view showing the invention in use.

Referring now to FIGS. 1–4, a first vertical support member 10 has a lower end adapted to rest on a supporting surface such as ground level. The height of member 10 can be manually adjusted using handle 12.

An elongated guide rod 14 extends in longitudinal direction and is normally inclined vertically by a user to aim at a basket.

A second elongated member 16 is secured rotatably at one end to one end of said rod and extends at right angles thereto. The other end of the second member is secured to adjustable wrist support 18 adapted for manual engagement and disengagement of a wrist of a user. This support can be made of velcro type material.

A hollow metal casing 20 open at both ends is secured to the upper end of the member in such manner as to be manually pivotable about a horizontal axis disposed at right angles to the longitudinal direction of the rod. The casing provides a guide channel through which the rod extends. The channel enables the rod to be manually slid back and forth in said longitudinal direction while preventing the rod from moving in any other direction.

The rod has a uniform cross section of square shape. The casing contains two spaced apart arrangements of roller bearings 22 so arranged that each of the four sides of the rod are engaged by two spaced sets of bearings, thus confining the motion of the rod to back and forth movement in the longitudinal direction and preventing any other type of motion.

In use, a player 24 with wrist secured in support 18 and the rod properly aimed releases the ball 26 as shown.

While the invention has been described with particular reference to the drawings and detailed description, the protection solicited is to be limited only by the terms of the claims that follow.

What is claimed is:

1. Apparatus for training basketball players in proper basketball shooting techniques for properly aiming and releasing a basketball, said apparatus comprising:

a first vertical support member having a upper and lower ends with the lower end adapted to rest on a supporting surface, said first member being manually adjustable in height whereby the upper end can be raised and lowered as required by the height of the player being trained;

an elongated guide rod extending in a longitudinal direction;

a hollow casing open at both ends and disposed on top of the upper end of the first support member, said casing being manually pivotable about a horizontal axis disposed at right angles to said longitudinal direction, said casing providing a guide channel through which said rod extends, said channel enabling the rod to be manually slidable back and forth in said longitudinal direction while preventing said rod from moving in any other direction;

an adjustable wrist support adapted for manual engagement and disengagement with the wrist of the player being trained; and a second elongated member secured rotatably at one end to one end of said rod and extending at right angles thereto, the other end of the second member being secured to said wrist support whereby wrist engagement of the support by the player being trained enables the player with basketball in hand to slide the guide rod as desired to properly aim and release the ball, wherein said rod has a uniform rectangular cross section with four side walls and said casing contains roller bearings engaging each of the four side walls to establish smooth sliding action for said rod.

* * * * *